US008833765B2

(12) United States Patent
Aono

(10) Patent No.: US 8,833,765 B2
(45) Date of Patent: Sep. 16, 2014

(54) PAPER SHEET CONVEYING APPARATUS AND IMAGE FORMING APPARATUS

(71) Applicant: Kyocera Document Solutions Inc., Osaka (JP)

(72) Inventor: Shinya Aono, Osaka (JP)

(73) Assignee: Kyocera Document Solutions, Inc., Osaka-shi (JP)

( * ) Notice: Subject to any disclaimer, the term of this patent is extended or adjusted under 35 U.S.C. 154(b) by 0 days.

(21) Appl. No.: 14/053,471

(22) Filed: Oct. 14, 2013

(65) Prior Publication Data

US 2014/0117610 A1 May 1, 2014

(30) Foreign Application Priority Data

Oct. 30, 2012 (JP) ..... 2012-239620

(51) Int. Cl.
*B65H 7/02* (2006.01)
*B65H 5/06* (2006.01)
*B65H 7/06* (2006.01)

(52) U.S. Cl.
CPC . *B65H 7/06* (2013.01); *B65H 5/062* (2013.01)
USPC ..... 271/265.02; 271/264; 271/258.01

(58) Field of Classification Search
USPC ..... 271/264, 265.01, 265.02, 256, 258.01, 271/259; 318/265, 278, 47, 62, 77
See application file for complete search history.

(56) References Cited

U.S. PATENT DOCUMENTS

| | | | | |
|---|---|---|---|---|
| 1,993,579 | A * | 3/1935 | Wright | 101/220 |
| 6,101,426 | A * | 8/2000 | Kimura et al. | 700/219 |
| 2002/0048231 | A1 * | 4/2002 | Ohtsu et al. | 369/30.36 |
| 2006/0284589 | A1 * | 12/2006 | Kuo | 318/696 |
| 2011/0194861 | A1 * | 8/2011 | Shiraishi | 399/21 |

FOREIGN PATENT DOCUMENTS

| | | | |
|---|---|---|---|
| JP | 07196208 | A | 8/1995 |
| JP | 2007076846 | A * | 3/2007 |

* cited by examiner

*Primary Examiner* — Michael McCullough
*Assistant Examiner* — Howard Sanders
(74) *Attorney, Agent, or Firm* — Alleman Hall McCoy Russell & Tuttle LLP

(57) ABSTRACT

A paper sheet conveying apparatus includes: a conveying path in which a paper sheet is conveyed; a plurality of conveying rollers; a plurality of driving motors; an out-of-step detection portion; a stop control portion; and a driving restart control portion. The plurality of conveying rollers are disposed along the conveying path. The plurality of driving motors rotates the conveying rollers. The out-of-step detection portion detects an out-of-step in each of the driving motors. The stop control portion stops each of the driving motors when an out-of-step is detected. The driving restart control portion drives, after each of the driving motors is stopped, a first driving motor in which an out-of-step has occurred, and a second driving motor in which no out-of-step occurs, under a driving start condition that an amount of rotation of the second driving motor is less than an amount of rotation of the first driving motor.

13 Claims, 5 Drawing Sheets

PAPER SHEET CONVEYING APPARATUS AND IMAGE FORMING APPARATUS

INCORPORATION BY REFERENCE

This application is based upon and claims the benefit of priority from the corresponding Japanese Patent Application No. 2012-239620 filed on Oct. 30, 2012, the entire contents of which are incorporated herein by reference.

BACKGROUND

The present disclosure relates to paper sheet conveying apparatuses and image forming apparatuses.

To image forming apparatuses, such as printers, facsimile apparatuses, copy machines, and multifunctional peripherals, paper sheet conveying apparatuses that convey paper sheets are mounted. As this type of paper sheet conveying apparatus, a paper sheet conveying apparatus that conveys paper sheets by rotating a plurality of conveying rollers which sandwich the paper sheet is known. Specifically, in the image forming apparatus, the paper sheet conveying apparatus is used to convey, to an image forming portion, paper sheets stacked in a sheet feed cassette, a manual feed tray, or the like.

In this type of paper sheet conveying apparatus, a stepping motor that rotates in synchronization with an inputted pulse signal is used as a driving source of the conveying roller. When the stepping motor is overloaded, an abnormal state called an out-of-step occurs in which the stepping motor does not rotate in synchronization with the inputted pulse signal, and the stepping motor may stop. Therefore, when the out-of-step occurs while a paper sheet is being conveyed, the conveying rollers stop and paper jam may occur. In conventional arts, when paper jam occurs, the image forming apparatus stops operating, and an error indicating that the paper jam has occurred is displayed, thereby prompting a user to remove a paper sheet jammed in the conveying rollers.

On the other hand, a technique is known in which, after an out-of-step occurs in a stepping motor that drives a belt for conveying paper sheets, driving of the stepping motor is restarted, to continuously convey the paper sheets by the belt.

SUMMARY

A paper sheet conveying apparatus according to one aspect of the present disclosure includes: a conveying path in which a paper sheet is conveyed; a plurality of conveying rollers; a plurality of driving motors; an out-of-step detection portion; a stop control portion; and a driving restart control portion. The plurality of conveying rollers are disposed along the conveying path. Each of the plurality of driving motors rotates respective one of the conveying rollers in synchronization with inputted driving signals. The out-of-step detection portion detects an out-of-step in each of the driving motors. The stop control portion stops each of the driving motors when the out-of-step detection portion detects the out-of-step. The driving restart control portion drives, after each of the driving motors is stopped by the stop control portion, a first driving motor, among the plurality of driving motors, in which an out-of-step has occurred, and at least one second driving motor, among the plurality of driving motors, in which no out-of-step occurs, under a driving start condition that an amount of rotation of the second driving motor is less than an amount of rotation of the first driving motor, by a predetermined delay amount.

An image forming apparatus according to another aspect of the present disclosure includes: a conveying path in which a paper sheet is conveyed; a plurality of conveying rollers; a plurality of driving motors; an out-of-step detection portion; a stop control portion; a driving restart control portion; and an image forming portion. The plurality of conveying rollers are disposed along the conveying path. Each of the plurality of driving motors rotates respective one of the conveying rollers in synchronization with inputted driving signals. The out-of-step detection portion detects an out-of-step in each of the driving motors. The stop control portion stops each of the driving motors when the out-of-step detection portion detects the out-of-step. The driving restart control portion drives, after each of the driving motors is stopped by the stop control portion, a first driving motor, among the plurality of driving motors, in which an out-of-step has occurred, and at least one second driving motor, among the plurality of driving motors, in which no out-of-step occurs, under a driving start condition that an amount of rotation of the second driving motor is less than an amount of rotation of the first driving motor, by a predetermined delay amount. The image forming portion forms an image on a paper sheet conveyed by the conveying rollers.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1A:
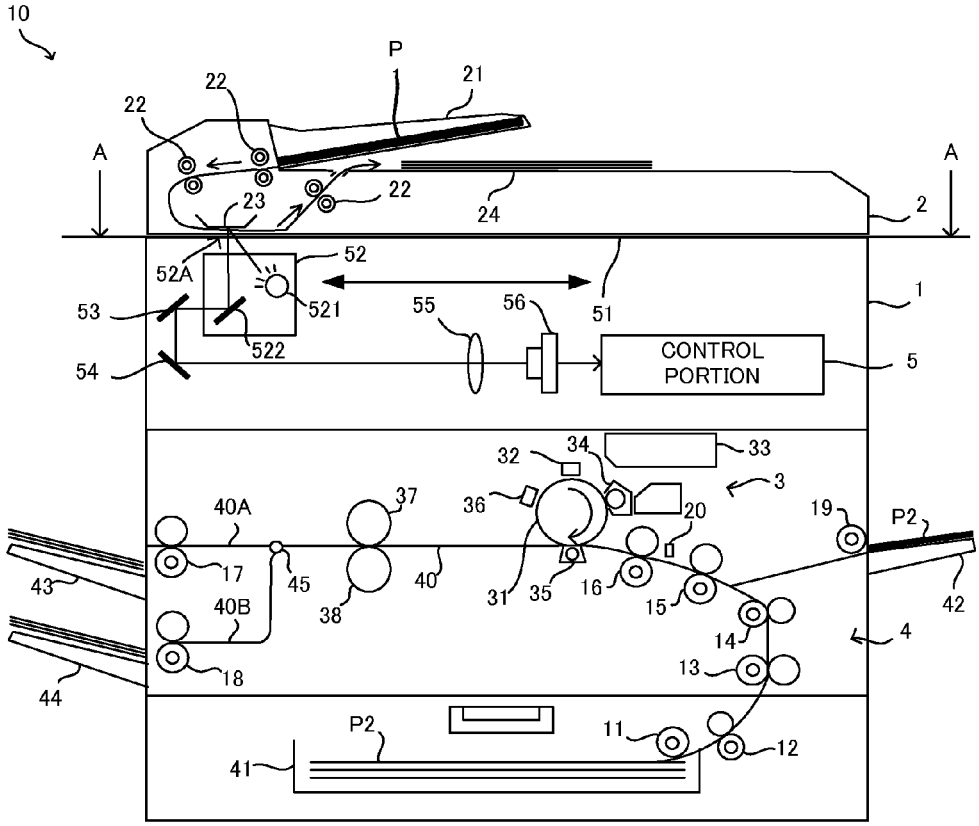
FIG. 1A and FIG. 1B illustrate a multifunctional peripheral according to one embodiment of the present disclosure.
Figure 1B:
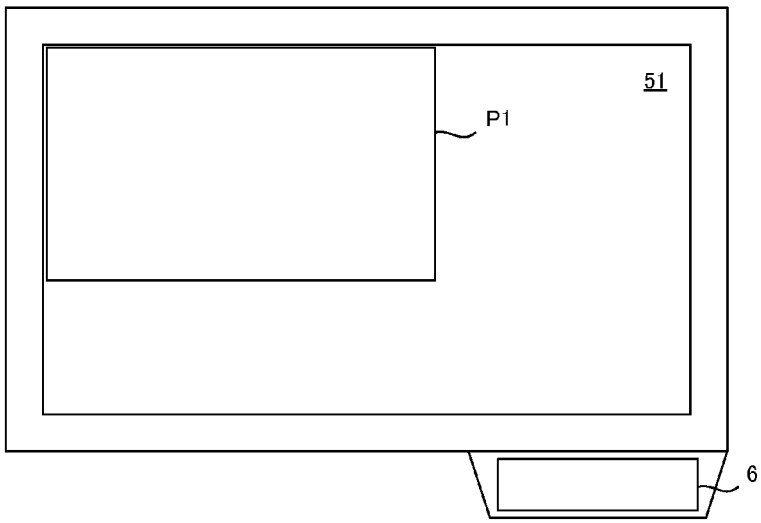

Firstly, a structure of a multifunctional peripheral 10 according to an embodiment of the present disclosure will be described with reference to FIGS. 1A and 1B. FIG. 1A is a cross-sectional view of the multifunctional peripheral 10, and FIG. 1B is a view as seen from the direction of arrows A in FIG. 1A.

The multifunctional peripheral 10 is an image forming apparatus that includes an image reading portion 1, an ADF 2, an image forming portion 3, a sheet feed portion 4, a control portion 5, an operation display portion 6, and the like. The operation display portion 6 includes a touch panel that displays various information according to instructions from the control portion 5, and allows input, to the control portion 5, of various information according to operations of users.

The multifunctional peripheral 10 is merely an example of the image forming apparatus according to the present disclosure. For example, the present disclosure is also applicable to image forming apparatuses such as printers, facsimile apparatuses, and copy machines. Further, an apparatus that includes the sheet feed portion 4 and the control portion 5 is an example of the paper sheet conveying apparatus according to the present disclosure.

The image reading portion 1 includes a contact glass 51, a reading unit 52, mirrors 53 and 54, an optical lens 55, a CCD (Charge Coupled Device) 56, and the like. The contact glass 51 is provided on the top surface of the image reading portion 1, and is a transparent document sheet table on which a document sheet P1 having an image to be read by the multifunctional peripheral 10 is placed. The image reading portion 1 is controlled by the control portion 5 so as to read image data from the document sheet P1 placed on the contact glass 51.

The reading unit 52 includes a LED light source 521 and a mirror 522, and can be moved, in the left-right direction (secondary scanning direction) in FIG. 1A, by a not-illustrated movement mechanism having a driving motor such as a stepping motor. By moving the reading unit 52 in the secondary scanning direction by the driving motor, scanning in the secondary scanning direction is performed with light applied to the contact glass 51 from the LED light source 521.

The LED light source 521 has multiple white LEDs aligned along a depth direction (the primary scanning direction) in FIG. 1A, and applies one line of white light to the document sheet P1 at a reading position 52A on the contact glass 51. The reading position 52A shifts in the secondary scanning direction according to the reading unit 52 moving in the secondary scanning direction.

The mirror 522 reflects, toward the mirror 53, light emitted by the LED light source 521 and reflected by the document sheet P1 at the reading position 52A. The light reflected by the mirror 522 is guided to the optical lens 55 by the mirrors 53 and 54. In the optical lens 55, light incident thereon is collected to be incident on the CCD 56.

The CCD 56 is a photoelectric converter that converts the received light to an electrical signal (voltage) based on an amount of the received light, to output the electrical signal as image data. Specifically, the CCD 56 reads image data of the document sheet P1 based on the light emitted by the LED light source 521 and reflected by the document sheet P1. The image data read by the CCD 56 is inputted to the control portion 5.

The ADF 2 is an automatic document feeder that includes a document sheet set portion 21, plural pairs of conveying rollers 22, a document sheet holder 23, a document sheet discharge portion 24, and the like.

The ADF 2 operates to convey the document sheet P1 set on the document sheet set portion 21, through the reading position 52A on the contact glass 51, to the document sheet discharge portion 24, by the plural pairs of conveying rollers 22 being driven by not-illustrated stepping motors. At this time, image data is read, by the image reading portion 1, from the document sheet P1 that passes through the reading position 52A.

The document sheet holder 23 is provided so as to be above and distant from the reading position 52A on the contact glass 51, by a space that allows the document sheet P1 to pass therebetween. The document sheet holder 23 has a longitudinal dimension in the primary scanning direction, and has a white sheet adhered to the bottom surface (the surface on the contact glass 51 side) thereof. In the multifunctional peripheral 10, image data of the white sheet is read as white reference data. The white reference data is used for well-known shading correction, or the like.

The image forming portion 3 is an electrophotographic type image forming portion that executes an image forming process (printing process) based on the image data read by the image reading portion 1 or image data inputted from an information processing apparatus such as an external personal computer.

Specifically, the image forming portion 3 includes a photosensitive drum 31, a charging device 32, an LSU (laser scanning unit) 33, a developing device 34, a transfer roller 35, a charge eliminating device 36, a fixing roller 37, a pressurizing roller 38, and the like. In the image forming portion 3, an image is formed on a paper sheet P2 conveyed by the sheet feed portion 4, in the following procedures, and the paper sheet P2 on which the image has been formed is discharged into a previously selected one of sheet discharge trays 43 or 44 described below.

Firstly, the photosensitive drum 31 is uniformly charged at a predetermined potential by the charging device 32. Next, light based on the image data is applied to the surface of the photosensitive drum 31 by the LSU 33. Thus, an electrostatic latent image is formed on the surface of the photosensitive drum 31. The electrostatic latent image on the photosensitive drum 31 is developed (visualized) as a toner image by the developing device 34. Subsequently, the toner image formed on the photosensitive drum 31 is transferred to the paper sheet P2 by the transfer roller 35. Thereafter, the toner image having been transferred to the paper sheet P2 is heated, and fused and fixed onto the paper sheet P2 by the fixing roller 37 when the paper sheet P2 passes between the fixing roller 37 and the pressurizing roller 38 and is discharged. The potential of the photosensitive drum 31 is eliminated by the charge eliminating device 36.

The sheet feed portion 4 includes a paper sheet conveying path 40, a sheet feed cassette 41, a manual feed tray 42, the sheet discharge trays 43 and 44, a conveyance switching portion 45, pickup rollers 11 and 19, a plurality of conveying rollers 12 to 16, a registration sensor 20, a pair of sheet discharge rollers 17, a pair of sheet discharge rollers 18, and the like. The photosensitive drum 31, the transfer roller 35, the fixing roller 37, and the pressurizing roller 38 of the image forming portion 3, and the like are also conveying rollers that convey the paper sheet P2, and may be regarded as a portion of the sheet feed portion 4.

The paper sheet conveying path 40 is a conveying path, for the paper sheet P2, which extends from the sheet feed cassette 41 or the manual feed tray 42 through the image forming portion 3 to the sheet discharge tray 43 or 44. In the description herein, in the direction in which the paper sheet P2 is conveyed in the paper sheet conveying path 40, the sheet feed cassette 41 side or the manual feed tray 42 side is referred to as the upstream side, and the sheet discharge tray 43 side or the sheet discharge tray 44 side is referred to as the downstream side. The pickup rollers 11 and 19, the conveying rollers 12 to 16, the pair of sheet discharge rollers 17, and the pair of sheet discharge rollers 18 are disposed along the paper sheet conveying path 40. The pickup rollers 11 and 19, the conveying rollers 12 to 16, the pair of sheet discharge rollers 17, and the pair of sheet discharge rollers 18 are driven by individual stepping motors, respectively, controlled by the control portion 5. Note that, for example, plural pairs of rollers, such as the conveying rollers 12 to 14, may be driven by one stepping motor.

The paper sheets P2 stored in the sheet feed cassette 41 are taken one by one from the sheet feed cassette 41 and fed into the paper sheet conveying path 40 by rotation of the pickup roller 11. On the other hand, the paper sheets P2 placed in the manual feed tray 42 are taken one by one from the manual feed tray 42 and fed into the paper sheet conveying path 40 by rotation of the pickup roller 19. The paper sheet P2 fed into the paper sheet conveying path 40 is conveyed to the image forming portion 3 by the conveying rollers 12 to 16.

The registration sensor 20 is an optical sensor that detects the paper sheet P2 conveyed in the paper sheet conveying path 40. The control portion 5 determines a position of the leading end of the paper sheet P2 based on the detection result from the registration sensor 20, and controls a time when the paper sheet P2 is to be fed to the image forming portion 3 by the conveying roller 16, thereby aligning the position of the leading end of the paper sheet P2 with a position where an image drawing is to be started in image formation. The conveying roller 16 used for controlling the conveying of the paper sheet P2 is usually referred to as a registration roller.

Further, the paper sheet conveying path 40 forks at a position of the conveyance switching portion 45, and includes a conveying path 40A that communicates with the sheet discharge tray 43 and a conveying path 40B that communicates with the sheet discharge tray 44. A destination to which the paper sheet P2 having an image formed by the image forming portion 3 is conveyed, is switched by the conveyance switching portion 45 to one of the conveying path 40A or the conveying path 40B. The conveyance switching portion 45 includes, for example, a driving portion, such as a solenoid or a motor, which is drive-controlled by the control portion 5, and a diverter that is operated by the driving portion to switch a direction in which the paper sheet P2 is conveyed, and convey the paper sheet P2 to one of the conveying path 40A or the conveying path 40B.

The pair of sheet discharge rollers 17 operates to discharge the paper sheet P2 having an image formed by the image forming portion 3, through the conveying path 40A, to the sheet discharge tray 43, whereas the pair of sheet discharge rollers 18 operates to discharge the paper sheet P2 having an image formed by the image forming portion 3, through the conveying path 40B, to the sheet discharge tray 44.

Figure 2:
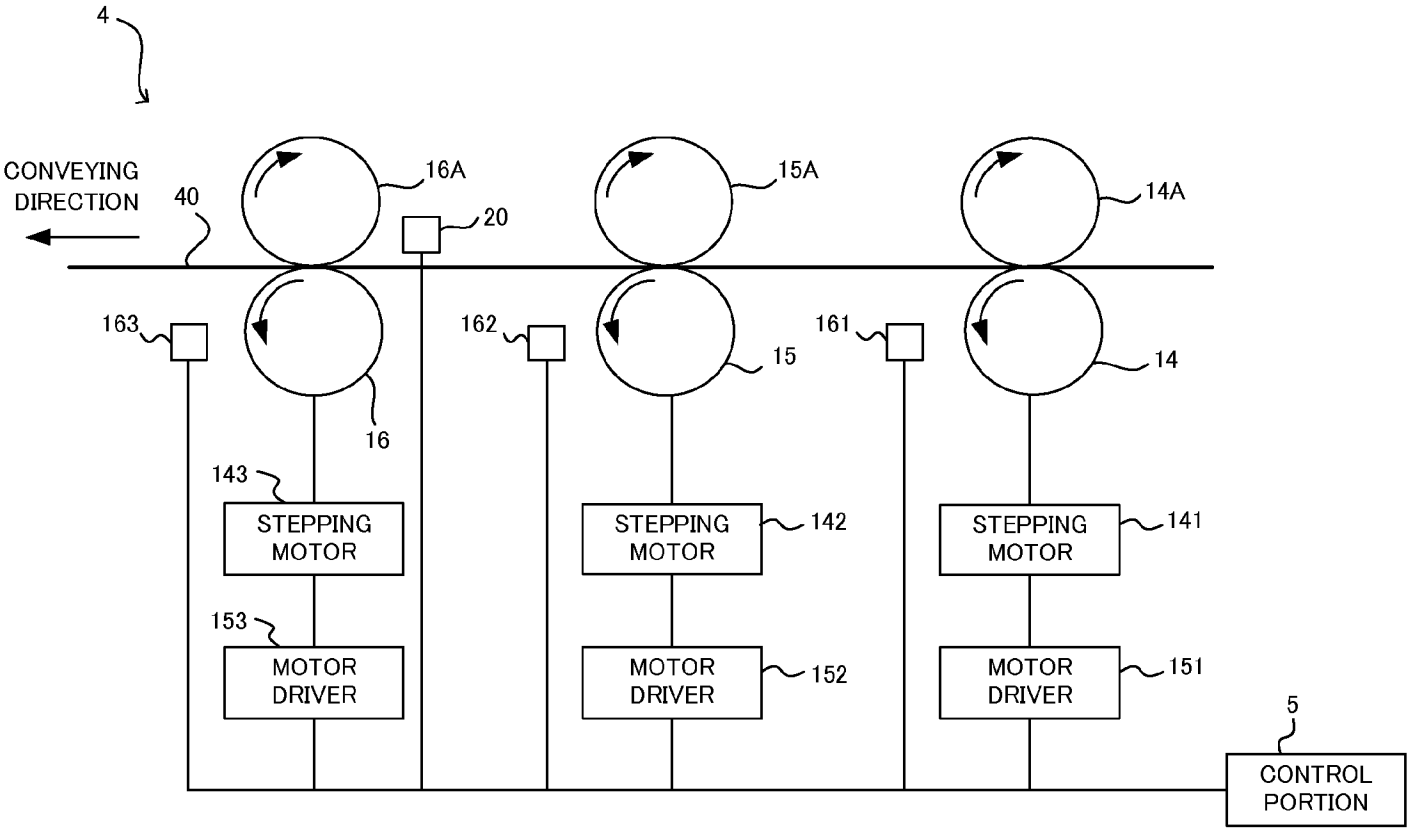
FIG. 2 is a block diagram illustrating a main portion of a sheet feed portion of the multifunctional peripheral according to the embodiment of the present disclosure.

Next, a main portion of the sheet feed portion 4 will be described with reference to FIG. 2. FIG. 2 is a block diagram illustrating a structure of the sheet feed portion 4. Hereinafter, although, in the present embodiment, among rollers that function as the conveying rollers that convey the paper sheet P2 in the sheet feed portion 4, the conveying rollers 14 to 16 will be described as an example, other rollers are structured in the same manner.

As shown in FIG. 2, the sheet feed portion 4 includes an opposing roller 14A disposed in contact with the conveying roller 14, an opposing roller 15A disposed in contact with the conveying roller 15, and an opposing roller 16A disposed in contact with the conveying roller 16. The opposing rollers 14A, 15A, and 16A rotate according to the rotation of the conveying rollers 14, 15, and 16, respectively.

Further, the sheet feed portion 4 includes stepping motors 141 to 143 (examples of driving motors), motor drivers 151 to 153, and encoders 161 to 163. Hereinafter, the stepping motors 141 to 143 may be abbreviated as the motors 141 to 143, respectively, and the motor drivers 151 to 153 may be abbreviated as the drivers 151 to 153, respectively.

The motor 141 is a synchronous motor that is coupled to the conveying roller 14 via a gear or the like, and rotates the conveying roller 14 by a predetermined angle in synchronization with a pulse signal (driving signal) inputted from the driver 151. Similarly, the motors 142 and 143 are coupled to the conveying rollers 15 and 16, respectively, via gears or the like, and rotate the conveying rollers 15 and 16 in synchronization with pulse signals (driving signals) inputted from the drivers 152 and 153, respectively. The motors 141 to 143 are merely examples of the driving motors according to the present disclosure, and may be other types of synchronous motors that rotate the conveying rollers in synchronization with inputted driving signals.

The driver 151 sequentially outputs pulse signals inputted from the control portion 5, to coils for each phase of the motor 141, to energize the coils, thereby driving the motor 141. Similarly, the drivers 152 and 153 drive the motors 142 and 143, respectively.

The encoder 161 is a rotary encoder that includes a rotating plate (not shown) coupled to a rotation shaft of the motor 141, and an optical sensor (not shown) that detects a slit (not shown) formed in the rotating plate. The encoder 161 inputs a detection result of the optical sensor to the control portion 5. The slits are formed in the rotating plate so as to be spaced from each other by a distance corresponding to a driving amount obtained when one pulse of a driving signal is inputted to the motor 141, for example. Similarly, the encoders 162 and 163 are rotary encoders coupled to rotation shafts of the motors 142 and 143, respectively. Thus, the control portion 5 is allowed to detect, for example, rotation angles of the motors 141 to 143 based on the detection results inputted from the encoders 161 to 163.

In the below description, for the convenience of description, the motors 141 to 143 may be collectively referred to as the motor 140, the drivers 151 to 153 may be collectively referred to as the driver 150, and the encoders 161 to 163 may be collectively referred to as the encoder 160.

When the motor 140 is under heavy load, an abnormal state called an "out-of-step" may occur in which the motor 140 is not driven in synchronization with a pulse signal inputted from the driver 150, whereby the motor 140 may stop.

Therefore, in a case where the detection result inputted from the encoder 160 does not agree with an amount of rotation corresponding to the number of pulses inputted to the driver 150, the control portion 5 individually detects an out-of-step of each motor 140. When the control portion 5 detects an out-of-step of each motor 140, the control portion 5 functions as an exemplary out-of-step detection portion.

The control portion 5 includes control devices such as a CPU, a ROM, a RAM, and an EEPROM. The control portion 5 comprehensively controls the multifunctional peripheral 10 by the CPU executing a predetermined control program stored in the ROM.

Specifically, a conveying control program that causes the CPU to execute a conveying control process (see FIG. 4) described below is stored in advance in the ROM. Further, the RAM is a volatile storage portion, and the EEPROM is a non-volatile storage portion, and are used as a temporary storage memory for various processes executed by the CPU. The control portion 5 may be configured by an electronic circuit such as an integrated circuit (ASIC, DSP), or may be a control portion that is provided separately from a main control portion that comprehensively controls the multifunctional peripheral 10.

The conveying control program is stored in a computer-readable storage medium such as a CD, a DVD, or a semiconductor memory (flash memory), and may be installed from the storage medium into a not-illustrated storage portion, such as a hard disk, provided in the multifunctional peripheral 10. The present disclosure may be implemented as the conveying control program or a computer-readable storage medium having the conveying control program stored therein.

Figure 3A:
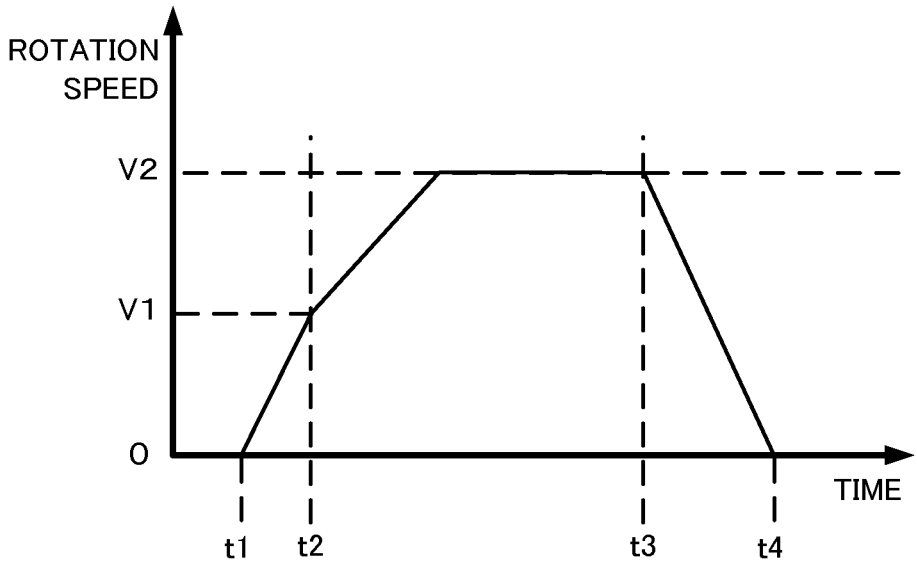
FIG. 3A and FIG. 3B illustrate a drive-control of a stepping motor of the multifunctional peripheral according to the embodiment of the present disclosure.
Figure 3B:
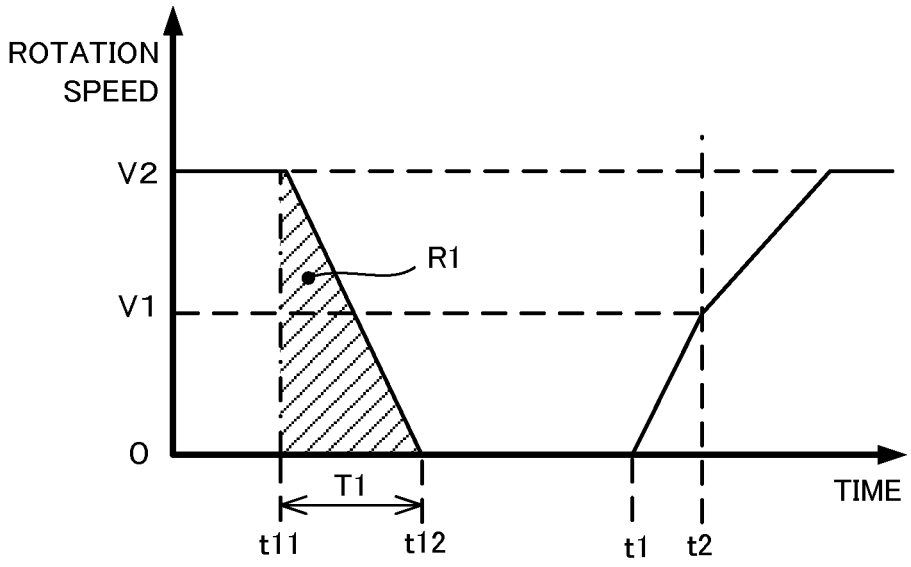

An example where the motor 140 is drive-controlled by the control portion 5 will be described with reference to FIGS. 3A and 3B. FIG. 3A illustrates a normal driving state, and FIG. 3B illustrates an example of a drive-control in the case of an out-of-step occurring.

In the present embodiment, the motors 141 to 143 have the same specifications, and the motors 141 to 143 are each controlled in the same manner when the driving is started and the driving is stopped.

As shown in FIG. 3A, the control portion 5 drives each motor 140 at a predetermined rotation speed V1 (time t1 to time t2) when the paper sheet P2 needs to be conveyed by the sheet feed portion 4 in the multifunctional peripheral 10 for, for example, execution of printing process. At this time, the control portion 5 executes a slow speed-increase control so as to accelerate a rotation speed of each motor 140 such that the rotation speed of each motor 140 gradually increases from 0 to the rotation speed V1. Specifically, the control portion 5 gradually enhances a frequency of a pulse signal inputted to the motor 140, thereby gradually increasing a rotation speed of the motor 140.

Thereafter, when the rotation speed of each motor 140 reaches the rotation speed V1 (time t2), the control portion 5 drives each motor 140 at a predetermined rotation speed V2. Also in this case, the control portion 5 executes a slow speed-increase control so as to accelerate the rotation speed of each motor 140 such that the rotation speed of each motor 140 gradually increases from the rotation speed V1 to the rotation speed V2. In the motor 140, the higher the rotation speed is, the less an allowable torque is. Therefore, an acceleration by which the rotation speed of the motor 140 increases from the rotation speed V1 to the rotation speed V2 may be less than an acceleration by which the rotation speed of the motor 140 increases from the rotation speed of 0 to the rotation speed V1. Note that an acceleration by which the rotation speed of the motor 140 increases from the rotation speed V1 to the rotation speed V2 may be equal to an acceleration by which the rotation speed of the motor 140 increases from the rotation speed of 0 to the rotation speed V1. The control portion 5 detects the number of rotations of each motor 140 based on the detection result from the encoder 160, and determines whether or not the rotation speed of each motor 140 has reached the rotation speed V2. Here, it is assumed that the rotation speed V1 is half the rotation speed V2 (V1=V2/2). Note that, after the rotation speed of each motor 140 has reached the rotation speed V1, the motor 140 may be driven as it is for a certain time period, and be then driven at the rotation speed V2.

On the other hand, the control portion 5 stops each motor 140 (time t3 to time t4) when the paper sheet P2 need not be conveyed by the sheet feed portion 4 in the multifunctional peripheral 10, for example, when the printing process is ended. At this time, the control portion 5 executes a slow speed-reduction control so as to decelerate and stop each motor 140 such that the rotation speed of each motor 140 is gradually reduced from the rotation speed V2 to 0. For example, the control portion 5 gradually lowers a frequency of a pulse signal inputted to the motor 140, thereby gradually reducing the rotation speed of the motor 140.

In the present embodiment, an acceleration (gradient of change in rotation speed) from start of driving of the motor 140 to the rotation speed V1, and an acceleration (gradient of change in rotation speed) from the rotation speed V2 having been reached when the motor 140 is to be stopped, to the stop of the motor 140, have the same absolute value.

Thus, in the multifunctional peripheral 10, driving of the motor 140 is controlled, by the control portion 5, by executing the slow speed-increase control and the slow speed-reduction control, in order to prevent load from being rapidly applied to each motor 140.

On the other hand, as shown in FIG. 3B, the control portion 5 stops driving each motor 140 when an out-of-step is detected (time t11) in one of the motors 140 during driving of each motor 140. However, at this time, although motors, among the motors 140, in which no out-of-step occurs are gradually stopped by the slow speed-reduction control (time t11 to time t12), the motor, among the motors 140, in which the out-of-step has occurred, is rapidly stopped when the out-of-step occurs (time t11). Therefore, the motors, among the motors 140, in which no out-of-step occurs, are stopped later than the motor in which the out-of-step has occurred. Therefore, a difference is generated between an amount of rotation of the motor, among the motors 140, in which the out-of-step has occurred, and an amount of rotation of the motors in which no out-of-step occurs, due to a difference in time when the motor is stopped. Specifically, the difference in amount of rotation is represented as an area of a region R1 that is calculated as a value obtained by integration for a stopping time period T1 from time t11 to time t12 shown in FIG. 3B.

Thus, in the sheet feed portion 4, when an out-of-step occurs in the motor 140, an amount of rotation becomes different among the motors 140. In a case where an out-of-step occurs in the motor 142 while the paper sheet P2 is being conveyed by the conveying rollers 14 to 16, after the conveying roller 15 is rapidly stopped, the conveying roller 14 located upstream thereof and the conveying roller 16 located downstream thereof stop later than conveying roller 15. Therefore, a problem may arise if, as shown in FIG. 3B, an out-of-step occurs in one of the motors 140 and all the motors 140 are stopped, and thereafter each motor 140 is simultaneously driven at time t1. Namely, in a case where the paper sheet P2 has reached the conveying roller 16 located downstream of the conveying roller 15, the paper sheet P2 is drawn by the rotation of the conveying roller 16, and therefore the motor 140 becomes overloaded when the driving is restarted, and an out-of-step may occur again. Further, in a case where the paper sheet P2 is left in the conveying roller 14 located upstream of the conveying roller 15, a deflection is caused in the paper sheet P2 by the rotation of the conveying roller 14, and conveying of the paper sheet P2 is restarted in a state where the paper sheet P2 has an excessive deflection when the driving is restarted, so that an abnormal state where, for example, the paper sheet P2 is deformed or jammed, may occur.

Therefore, in the multifunctional peripheral 10, the control portion 5 executes the conveying control process (see FIG. 4) described below, whereby a difference, in distance by which the paper sheet P2 is conveyed, which has occurred among the conveying rollers 14 to 16 due to the out-of-step occurring in the motor 140, is corrected when the driving of the motor 140 is restarted.

Figure 4:
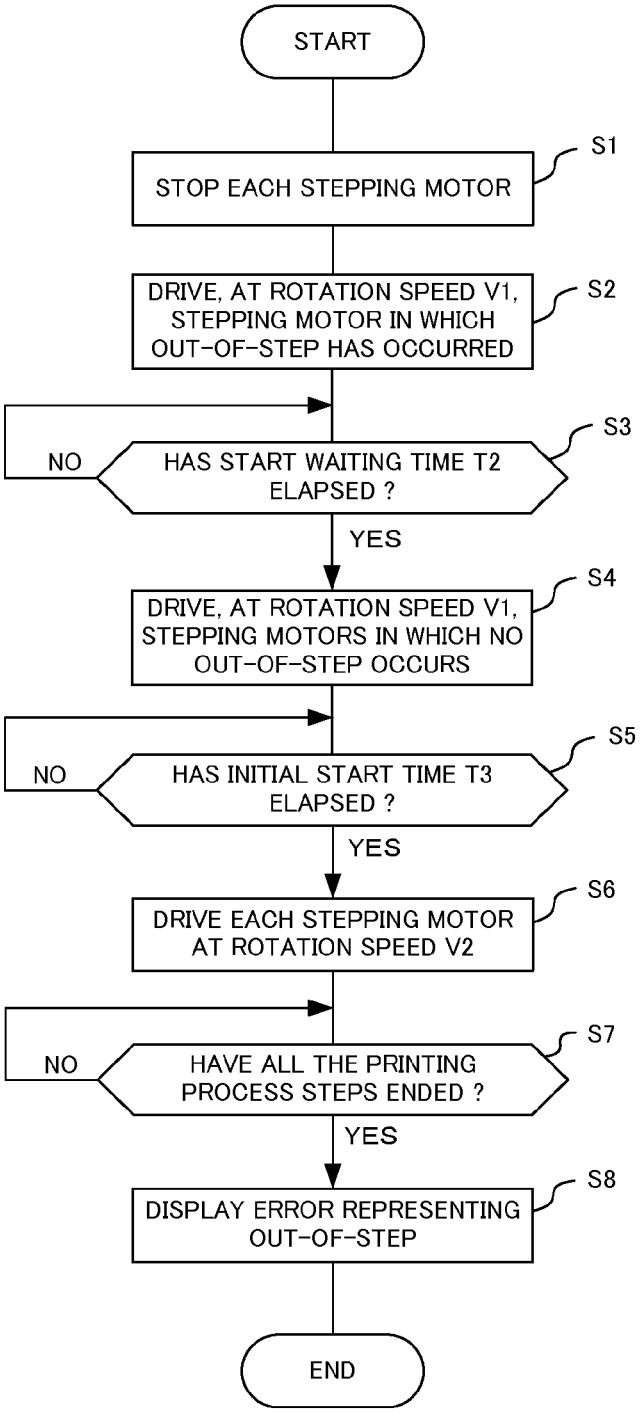
FIG. 4 is a flow chart showing process steps of a conveying control process of the multifunctional peripheral according to the embodiment of the present disclosure.

Hereinafter, process steps of the conveying control process executed by the control portion 5 will be described with reference to the flow chart of FIG. 4. The process steps executed by the control portion 5 are referred to as step S1, step S2 and so on.

Specifically, the control portion 5 executes the conveying control process in a case where an out-of-step is detected in one of the motors 140 while the printing process is being executed in the multifunctional peripheral 10. In the description herein, an exemplary case will be described where the conveying control process is executed for the motors 140 that drive the conveying rollers 14 to 16 among rollers which function as conveying rollers for conveying the paper sheet P2 in the sheet feed portion 4. However, the same conveying control process may be executed for a plurality of motors for driving a plurality of rollers that may simultaneously contact one paper sheet P2.

Firstly, when an out-of-step is detected in one of the motors 140, the control portion 5 stops conveying the paper sheet P2 in the sheet feed portion 4 in step S1. Specifically, the control portion 5 stops each motor 140, to stop the conveying rollers 14 to 16. When the control portion 5 executes step S1, the control portion 5 functions as a stop control portion.

The control portion 5 stops input of a pulse signal to the motor, among the motors 140, in which the out-of-step has occurred, to rapidly stop the motor. On the other hand, the control portion 5 executes the slow speed-reduction control to stop motors, among the motors 140, in which no out-of-step occurs.

Next, in step S2, the control portion 5 controls the driver 150 so as to start driving only the motor, among the motors 140, in which the out-of-step has occurred (time t21 in FIG. 5), such that the rotation speed thereof reaches the rotation speed V1. Namely, at this time, the motors, among the motors 140, in which no out-of-step occurs, are not driven.

Subsequently, in step S3, the control portion 5 waits for execution of the process steps until a predetermined start waiting time T2 elapses (the process for NO in S3). The start waiting time T2 represents a predetermined value for correcting a difference, in amount of rotation, which has occurred between the motor (corresponding to a first driving motor), among the motors 140, in which the out-of-step has occurred, and the motors (corresponding to a second driving motor) in which no out-of-step occurs, due to a difference in time when the motor is stopped. Namely, the start waiting time T2 represents an example of a driving start condition that an amount of rotation of the motors, among the motors 140, in which no out-of-step occurs is, less than, by a predetermined delay amount, an amount of rotation of the motor, among the motors 140, in which an out-of-step has occurred.

Specifically, in the example shown in FIGS. 3A and 3B, a difference, in an amount of rotation, corresponding to the area of the region R1 is generated due to a difference between a time when the motor, among the motors 140, in which the out-of-step has occurred, is stopped, and a time when the motors, among the motors 140, in which no out-of-step occurs, are stopped. Further, the rotation speed V1 is half the rotation speed V2. Furthermore, an acceleration by which the rotation speed of the motor 140 increases to reach the rotation speed V1 at the start of driving of the motor 140, and an acceleration, for stopping the motor 140, by which the rotation speed of the motor 140 decreases from the rotation speed V2 to stop of the motor 140, have the same absolute value. Therefore, the start waiting time T2 may be preset as a time, which is as long as the stopping time period T1 from time t11 to time t12, during which the motors, among the motors 140, in which no out-of-step occurs, stop. The stopping time period T1 is known since the stopping time period T1 is a time required for stopping the motors 140 by the slow speed-reduction control.

When the control portion 5 determines that the start waiting time T2 has elapsed (when the determination indicates YES in step S3), the process is advanced to step S4.

The start waiting time T2 for the motor located upstream of the motor, among the motors 140, in which the out-of-step has occurred, and the start waiting time T2 for the motor located downstream of the motor, among the motors 140, in which the out-of-step has occurred, may be set as values different from each other. For example, when the conveying roller 15 is stopped due to an out-of-step, an amount by which the paper sheet P2 is drawn due to the conveying roller 16 rotating after the conveying roller 15 is stopped, is limited. Therefore, an amount of deflection caused in the paper sheet P2 due to rotation of the conveying roller 14 may be greater than the amount of drawing of the paper sheet P2. Therefore, the control portion 5 may set the start waiting time T2 for the motor 143 located downstream of the conveying roller 15 so as to be shorter than the start waiting time T2 for the motor 141 located upstream of the conveying roller 15, in a case where an out-of-step occurs in the motor 142.

In step S4, the control portion 5 controls the driver 150 so as to start driving the motors, among the motors 140, in which no out-of-step occurs, such that the rotation speed of the motors reaches the rotation speed V1. Namely, after each motor 140 is stopped in step S1, the control portion 5 performs control such that driving of the motor, among the motors 140, in which the out-of-step has occurred is started earlier, and start of driving of the motors, among the motors 140, in which no out-of-step occurs, is delayed, by the start waiting time T2, from the start of driving of the motor, among the motors 140, in which the out-of-step has occurred. When the control portion 5 executes steps S2 to S4, the control portion 5 functions as a driving restart control portion.

Figure 5:
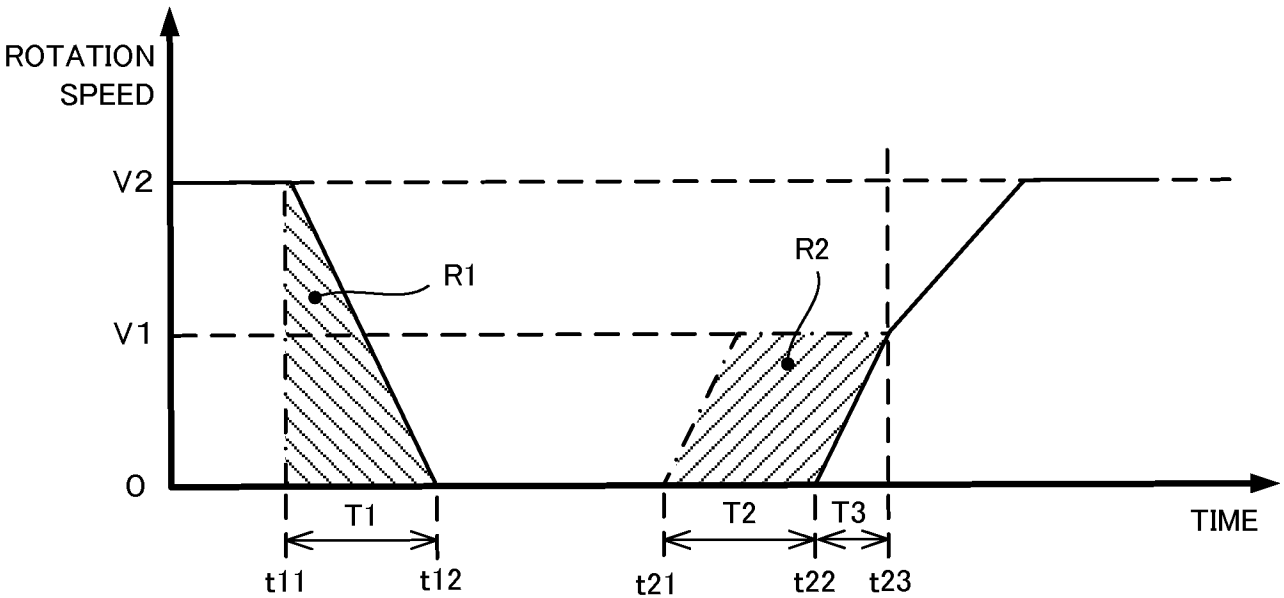
FIG. 5 illustrates a result obtained by executing the conveying control process of the multifunctional peripheral according to the embodiment of the present disclosure.

Specifically, as shown in FIG. 5, driving of the motors, among the motors 140, in which no out-of-step occurs is started at time t22 that is later than, by the start waiting time T2, time t21 when driving of the motor in which the out-of-step has occurred is started. Thus, an amount of rotation of the motors in which no out-of-step occurs becomes less than an amount of rotation of the motor, among the motors 140, in which the out-of-step has occurred, by a value corresponding to an area of a region R2 which is equal to the area of the region R1. Therefore, a difference in amount of rotation which occurs due to a difference between a time when the motor, among the motors 140, in which the out-of-step has occurred, is stopped, and a time when the motors in which no out-of-step occurs, are stopped, is corrected. Namely, a difference, in distance by which the paper sheet P2 has been conveyed, among the conveying rollers 14 to 16 is corrected, and a state where the paper sheet P2 is conveyed is restored to a state where the paper sheet P2 has been conveyed before occurrence of the out-of-step in the motor 140.

In step S5, the control portion 5 waits for execution of process steps until a predetermined initial start time T3 elapses (the process for NO in S5). The initial start time T3 is a time which is preset as a time up to time t23 at which the rotation speed of each motor 140 reaches the rotation speed V1. The initial start time T3 in which the rotation speed of each motor 140 reaches the rotation speed V1 represents a known value that is determined depending on the contents of the slow speed-increase control. The control portion 5 may detect the number of rotations of each motor 140 based on the detection result from the encoder 160, and determine whether or not the rotation speed of each motor 140 has reached the rotation speed V1.

When the control portion 5 determines that the initial start time T3 has elapsed (when the determination indicates YES in S5), the process is advanced to step S6.

In step S6, the control portion 5 rotates each motor 140 at the rotation speed V2. Thus, when each motor 140 rotates at the rotation speed V2, the paper sheet P2 is conveyed at a normal conveying speed by each of the conveying rollers 14 to 16.

In another embodiment, the control portion 5 may drive the motor 140 at the rotation speed V1 until an image formation or a series of printing process steps for the paper sheet P2 which has been conveyed at the occurrence of an out-of-step in the motor 140, is ended.

Thereafter, in step S7, the control portion 5 waits for execution of process steps until all the printing process steps designated by a user is ended (process for NO in S7). When it is determined that all the printing process steps have been ended (when the determination indicates YES in step S7), the control portion 5 advances the process to step S8.

If an out-of-step occurs in the motor 140 before all the printing process steps are ended, steps S1 to S6 are similarly executed by the control portion 5. However, in a case where an out-of-step occurs in the motor 140 after steps S1 to S6 are repeated for a predetermined number of times (for example, twice or three times), the control portion 5 stops the printing process, and indicates an error on the operation display portion 6.

When all the printing process steps are ended, the control portion 5 controls the operation display portion 6 to display, on the operation display portion 6, an error indicating that the out-of-step has occurred in one of the motors 140, in step S8. Thus, when the control portion 5 executes a process step in which a detection result for an out-of-step of each motor 140 is displayed, the control portion 5 functions as an out-of-step display portion. Thus, a user can know that an out-of-step has occurred in each motor 140, and can know that maintenance is needed, for example.

In another embodiment, the control portion 5 may indicate, during printing, an error indicating that an out-of-step has been detected, on the operation display portion 6. Further, in another embodiment, the control portion 5 may perform control so as to store the number of times an out-of-step is detected, as history information, in the EEPROM of the control portion 5. Thus, the history information is made available to a service person at an upcoming maintenance, for example. Further, the control portion 5 may indicate an error on the operation display portion 6 at a time when an out-of-step is detected for a predetermined number of times, based on the history information.

As described above, in the multifunctional peripheral 10, when driving of each motor 140 is restarted after an out-of-step has occurred in one of the motors 140, a difference, in distance by which the paper sheet P2 is conveyed, which occurs among the conveying rollers 14 to 16 due to the out-of-step having occurred in the one of the motors 140, is corrected.

Therefore, in the multifunctional peripheral 10, even after an out-of-step has occurred in one of the motors 140 that drive the conveying rollers 14 to 16 for conveying the paper sheet P2 in the sheet feed portion 4, the paper sheet P2 can be normally conveyed as it is. Therefore, a user can be freed from removing the paper sheet P2 when paper jam has occurred due to occurrence of an out-of-step in the motor 140.

Further, in the multifunctional peripheral 10, the paper sheet P2 that has been temporarily kept from being conveyed due to an out-of-step in the motor 140 can be used as it is to allow the image forming portion 3 to continue the image forming process. Therefore, wasting of the paper sheets P2 is prevented.

In a case where the image forming portion 3 continues the image forming process, the control portion 5 may change contents of the image forming process steps performed by, for example, the photosensitive drum 31 and the LSU 33 in the image forming portion 3, according to the rotation speed of each motor 140 being changed. For example, until the rotation speed reaches the rotation speed V2 when driving of each motor 140 is restarted, the control portion 5 may rotate the photosensitive drum 31 and the transfer roller 35 at the same rotation speed as those of the conveying rollers 14 to 16. Further, the control portion 5 controls the LSU 33, to change a speed (scanning speed) at which an image is formed on the photosensitive drum 31 by the LSU 33 according to a speed of the photosensitive drum 31.

On the other hand, the control portion 5 may cancel, in a state where the paper sheet P2 is not conveyed to the image forming portion 3, an image that has been already formed on the photosensitive drum 31, and an image may be formed again on the photosensitive drum 31 based on speeds, at the restart of the driving, of the conveying rollers 14 to 16. For example, a case is assumed where the rotation speed of the motor 140 is the rotation speed V1 that is half the normal rotation speed V2 until the printing process is ended after restart of driving of the conveying rollers 14 to 16. In this case, the control portion 5 may generate, as an image corresponding to image data to be printed, image data representing an image that is elongated two-fold in the secondary scanning direction, and may cause the image forming portion 3 to execute the image forming process based on the image data. Thus, in a case where a speed at which the paper sheet P2 is conveyed after restart of driving of the conveying rollers 14 to 16 is half the normal conveying speed, an image formed on the photosensitive drum 31 may be transferred to the paper sheet P2 at an original size in the transfer process. Therefore, an image can be normally formed without changing conditions of processes of the image forming portion 3 such as a rotation speed of the photosensitive drum 31 and a speed at which the LSU 33 performs image formation.

Other Embodiments

In the embodiment described above, as an example of the driving start condition, an example is described where a driving start time of a motor, among the motors 140, in which an out-of-step has occurred and a driving start time of motors in which no out-of-step occurs, are different.

On the other hand, the driving start condition may be, for example, a condition that the control portion 5 restarts driving a motor, among the motors 140, in which an out-of-step has occurred and motors, among the motors 140, in which no out-of-step occurs, at the same time, and the rotation speeds at the restart of the driving may be different therebetween. Specifically, the control portion 5 restarts driving the motors, among the motors 140, in which no out-of-step occurs, at a predetermined rotation speed that is lower than a speed at which the motor in which the out-of-step has occurred is driven. At this time, a difference in rotation speed may be preset as a value that enables correction of a difference, in distance by which the paper sheet P2 is conveyed, which occurs among the conveying rollers 14 to 16 due to a difference between a time when the motor, among the motors 140, in which the out-of-step has occurred, is stopped, and a time when motors in which no out-of-step occurs, are stopped.

Further, according to the rotation speed V1 or the rotation speed V2 of each motor 140 being changed, an appropriate set value of the start waiting time T2 is changed. When a speed at which the paper sheet P2 is conveyed is changed according to a type of the paper sheet P2 conveyed by the sheet feed portion 4, or an image quality of an image formed on the paper sheet P2 conveyed by the sheet feed portion 4, the rotation speed V1 is changed according to situations. Therefore, in another embodiment, the start waiting time T2 associated with each speed at which the paper sheet P2 is conveyed may be stored in the ROM or the EEPROM of the control portion 5, and the control portion 5 may select from the start waiting times T2 according to a speed at which the paper sheet P2 is conveyed, to execute the conveying control process.

Further, in another embodiment, the control portion 5 may measure a difference between a time when an out-of-step is detected in one of the motors 140 and a time when each motor, among the motors 140, in which no out-of-step occurs is stopped. When the control portion 5 executes the time measuring process, the control portion 5 functions as a time difference measuring portion. In this case, the control portion 5 is allowed to set the start waiting time T2 that enables correction of a difference, in an amount of rotation which occurs among the motors 140 due to an out-of-step, as appropriate, based on the time difference measured in the time measuring process, according to a predetermined expression or the like. Thus, the start waiting time T2 is set based on the time difference measured in the time measuring process, and a delay amount of rotation of the motors 140 used for correction in the conveying control process, is set. When the control portion 5 executes this setting process, the control portion 5 functions as a delay amount setting portion.

Thus, also when a conveying speed of the motor 140 is changed, the start waiting time T2 is appropriately set, so that a difference in amount of rotation among the motors 140 is corrected, thereby correcting a difference in conveying distance among the conveying rollers 14 to 16.

In particular, when, for example, a torque required for each motor 140 or a diameter of a roller member driven by each motor 140 is different, a control condition such as a rotation speed or an acceleration may be different among the motors 140. In this case, the control portion 5 may individually measure a difference between a time when an out-of-step is detected in one of the motors 140 and a time when each motor, among the motors 140, in which no out-of-step occurs is stopped. The control portion 5 may individually set, according to the time difference, the start waiting time T2 for each motor, among the motors 140, in which no out-of-step occurs. For example, in a case where an out-of-step occurs in the motor 142, the control portion 5 measures a first time difference between a time when the out-of-step is detected in the motor 142 and a time when the motor 141 is stopped, and a second time difference between the time when the out-of-step is detected in the motor 142 and a time when the motor 143 is stopped. The control portion 5 sets the start waiting time T2 used for driving the motor 141 according to the first time difference, and sets the start waiting time T2 used for driving the motor 143 according to the second time difference. Thus, even when the control conditions are different among the motors 140, the start waiting time T2 is set according to the control condition of each motor 140, thereby appropriately correcting a difference in amount of rotation generated when an out-of-step occurs. The same is applied to a case where a condition that the rotation speeds are made different is set as the driving start condition. In this case, the control portion 5 may change a difference in rotation speed as appropriate.

Further, in a case where an out-of-step occurs in the motor 140 after the paper sheet P2 has reached the image forming portion 3 in the paper sheet conveying path 40 of the sheet feed portion 4, an image may have been already formed on a portion of the paper sheet P2. In this case, even when, in the conveying control process, the motor 140 is drive-controlled to restart conveying the paper sheet P2, a standard image quality may not be obtained as a result of the printing.

Therefore, when an out-of-step is detected in the motor 140, the control portion 5 may identify a position of the paper sheet P2 in the paper sheet conveying path 40, and change a discharge destination to which the paper sheet P2 is discharged according to whether or not the identified position is in a range where image is formed on the paper sheet P2 by the image forming portion 3. When the control portion 5 executes a process for changing the discharge destination, the control portion 5 functions as a discharge control portion.

Specifically, the control portion 5 starts measuring time at a time when the paper sheet P2 is taken from the sheet feed cassette 41 by the pickup roller 11, thereby enabling identification of a position of the paper sheet P2 according to the measured time. Further, the control portion 5 may identify a position of the paper sheet P2 based on the detection result from a paper sheet detection sensor, such as the registration sensor 20, disposed in the paper sheet conveying path 40. When the control portion 5 executes a process for identifying a position of the paper sheet P2, the control portion 5 functions as a position identification portion.

In a case where, when an out-of-step occurs in the motor 140, the paper sheet P2 in the paper sheet conveying path 40 is at a position where an image is being formed on the paper sheet P2 by the image forming portion 3, the control portion 5 controls the conveyance switching portion 45 so as to set the sheet discharge tray 44 as the discharge destination for the paper sheet P2. On the other hand, in a case where, when an out-of-step occurs in the motor 140, the paper sheet P2 in the paper sheet conveying path 40 is not at a position where an image is being formed on the paper sheet P2 by the image forming portion 3, the control portion 5 controls the conveyance switching portion 45 so as to set the sheet discharge tray 43 as the discharge destination for the paper sheet P2. Thus, in a case where a standard image quality may not be obtained as a result of the printing, the paper sheet P2 can be discharged into the sheet discharge tray 44 that is not used in a normal state, whereby a user can be prompted to confirm the result of the printing. Further, after the paper sheet P2 is discharged into the sheet discharge tray 44, the control portion 5 may operate so as to feed the paper sheet P2 from the sheet feed cassette 41 anew, and causes the image forming portion 3 to execute again the image forming process, thereby discharging, into the sheet discharge tray 43, the paper sheet P2 in which the image has been formed. Thus, in a case where the printing process is performed for a plurality of paper sheets, only a bundle of paper sheets having images formed thereon with a standard image quality can be discharged into the sheet discharge tray 43 as a result of the printing, and the unnecessary paper sheet P2 that has been conveyed at the occurrence of an out-of-step can be prevented from being mixed.

Further, in the embodiment described above, an exemplary case is described where each motor 140 in which no out-of-step occurs is stopped by the slow speed-reduction control in step S1.

On the other hand, when an out-of-step occurs in one of the motors 140, the control portion 5 may forcibly generate an out-of step in each motor 140 in which no out-of-step occurs, to stop each motor 140. For example, in a case where a pulse signal is applied to each motor 140 at a frequency of 1000 [Hz], the control portion 5 may operate so as to change a frequency of the pulse signal to a high frequency of, for example, 2000 [Hz] in step S1. Thus, since an out-of-step occurs in each motor 140 and the motor 140 is rapidly stopped, the motor 140 is stopped in a shorter time as compared to a case where the motor 140 is stopped by the slow speed-reduction control. Namely, the control portion 5 can reduce a difference, in distance by which the paper sheet P2 is conveyed, which occurs among the conveying rollers 14 to 16 due to an out-of-step in the motor 140. Also in this case, a slight difference occurs between a time when the motor, among the motors 140, in which the out-of-step has occurred earliest, is stopped, and a time when the motors, among the motors 140, in which the out-of-step has forcibly been generated later, are stopped. In order to cancel the difference, the present disclosure is advantageously used.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A paper sheet conveying apparatus, comprising a conveying path in which a paper sheet is conveyed;

a plurality of conveying rollers disposed along the conveying path;

a plurality of driving motors configured to rotate the conveying rollers in synchronization with inputted driving signals;

an out-of-step detection portion configured to detect an out-of-step in each of the driving motors;

a stop control portion configured to stop each of the driving motors when the out-of-step detection portion detects the out-of-step; and a driving restart control portion configured to drive, after each of the driving motors is stopped by the stop control portion, a first driving motor, among the plurality of driving motors, in which an out-of-step has occurred, and at least one second driving motor, among the plurality of driving motors, in which no out-of-step occurs, under a driving start condition that an amount of rotation of the second driving motor is less than an amount of rotation of the first driving motor, by a predetermined delay amount.

2. The paper sheet conveying apparatus according to claim 1, wherein the delay amount represents a difference, between an amount of rotation of the first driving motor and an amount of rotation of the second driving motor, the difference occurring due to a difference between a time when the first driving motor is stopped and a time when the second driving motor is stopped.

3. The paper sheet conveying apparatus according to claim 2, wherein the driving start condition is a condition that a driving start time of the second driving motor is later than a driving start time of the first driving motor or a rotation speed of the second driving motor is lower than a rotation speed of the first driving motor.

4. The paper sheet conveying apparatus according to claim 3, further comprising:

a time difference measuring portion configured to measure a time difference between a time when an out-of-step is detected in the first driving motor by the out-of-step detection portion and a time when the at least one second driving motor is stopped; and a delay amount setting portion configured to set the delay amount based on the time difference measured by the time difference measuring portion.

5. The paper sheet conveying apparatus according to claim 4, wherein the time difference measuring portion individually measures a time difference between a time when an out-of-step is detected in the first driving motor by the out-of-step detection portion and a time when each second driving motor is stopped, and the delay amount setting portion individually sets the delay amount of each second driving motor based on the time difference that is individually measured for each second driving motor by the time difference measuring portion.

6. The paper sheet conveying apparatus according to claim 1, further comprising an out-of-step display portion configured to display a detection result from the out-of-step detection portion.

7. An image forming apparatus comprising:

a conveying path in which a paper sheet is conveyed;

a plurality of conveying rollers disposed along the conveying path;

a plurality of driving motors configured to rotate the conveying rollers in synchronization with inputted driving signals;

an out-of-step detection portion configured to detect an out-of-step in each of the driving motors;

a stop control portion configured to stop each of the driving motors when the out-of-step detection portion detects the out-of-step;

a driving restart control portion configured to drives, after each of the driving motors is stopped by the stop control portion, a first driving motor, among the plurality of driving motors, in which an out-of-step has occurred, and at least one second driving motor, among the plurality of driving motors, in which no out-of-step occurs, under a driving start condition that an amount of rotation of the second driving motor is less than an amount of rotation of the first driving motor, by a predetermined delay amount; and an image forming portion configured to form an image on a paper sheet conveyed by the conveying rollers.

8. The image forming apparatus according to claim 7, wherein the delay amount represents a difference, between an amount of rotation of the first driving motor and an amount of rotation of the second driving motor, the difference occurring due to a difference between a time when the first driving motor is stopped and a time when the second driving motor is stopped.

9. The image forming apparatus according to claim 8, wherein the driving start condition is a condition that a driving start time of the second driving motor is later than a driving start time of the first driving motor or a rotation speed of the second driving motor is lower than a rotation speed of the first driving motor.

10. The image forming apparatus according to claim 9, further comprising:

a time difference measuring portion configured to measure a time difference between a time when an out-of-step is detected in the first driving motor by the out-of-step detection portion and a time when the at least one second driving motor is stopped; and a delay amount setting portion configured to set the delay amount based on the time difference measured by the time difference measuring portion.

11. The image forming apparatus according to claim 10, wherein the time difference measuring portion individually measures a time difference between a time when an out-of-step is detected in the first driving motor by the out-of-step detection portion and a time when each second driving motor is stopped, and the delay amount setting portion individually sets the delay amount of each second driving motor based on the time difference that is individually measured for each second driving motor by the time difference measuring portion.

12. The image forming apparatus according to claim 7, further comprising an out-of-step display portion configured to display a detection result from the out-of-step detection portion.

13. The image forming apparatus according to claim 7, further comprising:

a position identification portion configured to identify a position of a paper sheet in the conveying path when an out-of-step is detected by the out-of-step detection portion; and a discharge control portion configured to determine a discharge destination to which the paper sheet is to be discharged, according to whether or not the position identified by the position identification portion is a position where an image is formed on the paper sheet by the image forming portion.

* * * * *